United States Patent [19]

Torii

[11] 4,115,015

[45] Sep. 19, 1978

[54] RETRACTABLE PEN WITH INTERNAL TIP SEATING

[75] Inventor: Osamu Torii, Kyoto, Japan

[73] Assignee: Ancos Co., Ltd., Osaka, Japan

[21] Appl. No.: 786,743

[22] Filed: Apr. 11, 1977

[51] Int. Cl.[2] ..... B43K 5/16; B43K 7/12; B43K 24/08

[52] U.S. Cl. ..... 401/110

[58] Field of Search ..... 401/109-111, 401/99-108, 111-117

[56] References Cited

U.S. PATENT DOCUMENTS

| | | | |
|---|---|---|---|
| 2,790,422 | 4/1957 | Grumbach | 401/104 X |
| 3,586,451 | 6/1971 | Canton | 401/33 |
| 3,652,173 | 3/1972 | Miller et al. | 401/110 |
| 3,653,777 | 4/1972 | Ritter | 401/110 |

FOREIGN PATENT DOCUMENTS

| | | | |
|---|---|---|---|
| 2,439,052 | 2/1976 | Fed. Rep. of Germany | 401/108 |

*Primary Examiner*—Ronald E. Suter
*Attorney, Agent, or Firm*—Sughrue, Rothwell, Mion, Zinn and Macpeak

[57] ABSTRACT

A retractable pen includes a slide cylinder (1) axially coupled to a push tube (17) and slidably but non-rotatably disposed in a surrounding body cylinder (25) and biased toward a retracted position therein by an internal spring (24). The front end of the slide cylinder defines an axially offset open hole (3) and an internal blind hole (3'), and a refill cartridge (8) having an axially offset writing tip (9) and a support tube 11 axially coupled to the cartridge are disposed within the slide cylinder/-push tube unit and rotatably but non-slidably coupled to the body cylinder. A grooved cam wall (5) and axially spaced cam ring (16) on the inner surface of the slide cylinder cooperate with cam followers (13) on the outer surface of the support tube, whereby the depression and release of the push tube sequentially effects the extension of the slide cylinder, the 180° rotation of the cartridge and tip, and the retraction of the slide cylinder, to thus transfer the tip between a writing position whereat it extends through the slide cylinder open hole and a retracted position whereat it is protectively seated in the internal blind hole. The cam wall is configured as two elongated slots spaced 180° apart and joined by convex oblique edges, the cam ring edge defines a zigzag surface matched to but spaced from and slightly rotationally offset from the cam wall oblique edges, and the cam followers are trapezoidal in shape.

5 Claims, 6 Drawing Figures

RETRACTABLE PEN WITH INTERNAL TIP SEATING

BACKGROUND OF THE INVENTION

This invention relates to a retractable writing implement, such as a fountain pen, a soft tip pen, or a ballpoint pen, and is particularly applicable to such a pen which uses a volatile ink supply.

In general, when a writing implement is not being used a cap is put over its tip to prevent it from becoming dried out and/or for the protection of the tip and the clothing of the user. With a pen which uses a volatile ink supply, capping is particularly essential to prevent the evaporation of the ink supply.

To use a capped pen the cap must first be removed, which is a bothersome two hand operation. In some pens the removed cap may be placed over the rear end of the pen body, but this is also rather troublesome, and the cap frequently works loose and becomes lost or mislaid.

In order to eliminate the above-described difficulties accompanying conventional capped writing implements, a variety of retractable pen designs have been proposed. These are generally intricate and costly to construct, however, and because of their complex design they are subject to frequent malfunction, such as jamming, and their repair is very difficult. Further, conventional retractable pens are often fatally disadvantageous in that the writing section is not satisfactorily sealed when the pen is not in use.

As examples of various prior art retractable pen constructions, see Japanese Patent Publications Nos. 45/16885, 45/22650, 50/13138, 50/9023, and 51/94322.

SUMMARY OF THE INVENTION

The drawbacks and disadvantages of the prior art are effectively overcome by the present invention, according to which a retractable pen includes a slide cylinder axially coupled to a push tube and slidably but non-rotatably disposed in a surrounding body cylinder and biased toward a retracted position therein by an internal spring. The front end of the slide cylinder defines an axially offset open hole and an internal blind hole, and a refill cartridge having an axially offset writing tip and a support tube axially coupled to the cartridge are disposed within the slide cylinder/push tube unit and rotatably but non-slidably coupled to the body cylinder. A grooved cam wall and axially spaced cam ring on the inner surface of the slide cylinder cooperate with cam followers on the outer surface of the support tube, whereby the depression and release of the push tube sequentially effects the extension of the slide cylinder, the 180° rotation of the cartridge and tip, and the retraction of the slide cylinder, to thus transfer the tip between a writing position whereat it extends through the slide cylinder open hole and a retracted position whereat it is protectively seated in the internal blind hole. The cam wall is configured as two elongated slots spaced 180° apart and joined by convex oblique edges, the cam ring edge defines a zig-zag surface matched to but spaced from and slightly rotationally offset from the cam wall oblique edges, and the cam followers are trapezoidal in shape.

DETAILED DESCRIPTION OF THE PREFERRED EMBODIMENT

Figure 1:
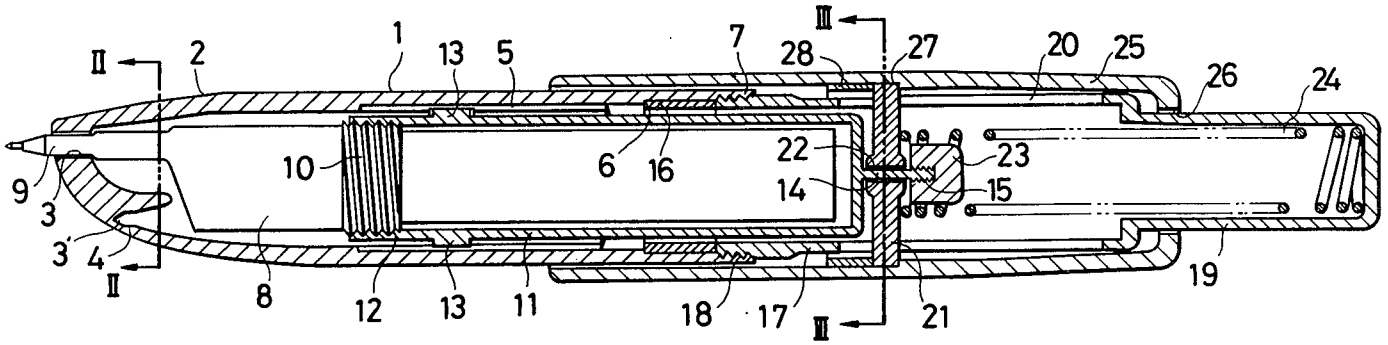
FIG. 1 shows a longitudinal sectional view of a retractable pen according to the present invention, with the writing section extended.
Figure 2:
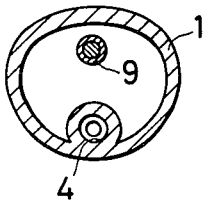
FIG. 2 shows a cross-sectional view taken along line II—II in FIG. 1.

Referring now to the drawings, FIG. 1 shows a sectional view along the central longitudinal axis of a retractable pen according to the invention, which is shown as a felt or nylon tip pen, by way of example only. Reference numeral 1 designates a slide cylinder having a tapered front end portion 2. The shape of the front end portion 2 is like that of a conventional fountain pen, for ease and convenience of use. A small hole 3 is provided above the axial centerline of the slide cylinder, and a blind hole 3' is provided in the front end portion 2 below the axial centerline to form a tip receiving section 4. The dimensions of the receiving section 4 are such that the writing section tip can be closely inserted therein. The construction of the front part of the slide cylinder 1 is clearly shown in FIG. 2. A cam wall 5, whose shape will be described later, is formed on the inner rear wall of the slide cylinder, in which a step or shoulder 6 is also defined at a spaced interval from the end of the cam wall 5. The shape of the step 6 coincides to the front end shape of an annular cam ring, to be described later. The rear end of the slide cylinder 1 is open, and its inner wall is provided with a female thread 7.

A refill cartridge 8 is inserted in the slide cylinder 1, and its front end portion is necked down to form a writing section 9 whose axis is displaced from the axis of the refill cartridge. In FIG. 1 the writing section 9 is shown extending through the hole 3 in the front end of the slide cylinder. A male thread 10 is formed in the middle part of the refill cartridge.

A refill support tube 11 open only at its front end has a female thread 12 formed on its inner front wall, and is fitted over the rear half of the cartridge 8 and engaged with the male thread 10 thereon. Two protruding cam followers 13 are formed on the outer front wall of the support tube 11, and these cams are slidably disposed in grooves formed in the cam wall 5 of the slide cylinder 1. A pin 14 is axially disposed at the rear center of the support tube, and a male thread 15 is formed on the end of the pin. An annular cam ring 16 is inserted into the slide cylinder 1 until the front end thereof engages the shoulder 6. The configuration of the front end of the cam ring will be described later.

A push tube 17 has a male thread 18 formed on the outer wall of its open front end, and is engaged with the female thread 7 on the slide cylinder 1 to secure the cam ring 16 in place and at the same time join the push tube to the slide cylinder. The rear end of the tube 17 is necked down to form a push cap 19, and approximately half of the middle portion of the tube 17 is cut away to from a semi-cylindrical notch section 20.

Figure 3:
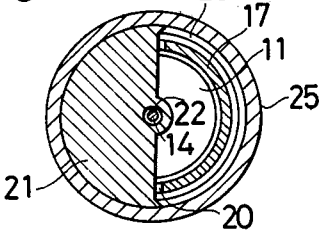
FIG. 3 shows a cross-sectional view taken along line III—III in FIG. 1.

A semi-circular support member 21, as best seen in FIG. 3, is shaped to fit into the notch section 20 of the push tube 17, and has a hole 22 at its center. After the pin 14 of the refill support tube 11 is inserted through the hole 22, a retaining nut 23 is screwed onto the male thread 15 of the pin, whereby the support tube and the refill cartridge 8 are freely rotatable. The push tube 17 and slide cylinder 1 are rearwardly biased by a spring 24 disposed between the support member 21 and the rear end of the push cap 19.

A body cylinder 25 has an open front end and a slightly tapered rear end defining an opening 26. A shoulder 27 is formed in the inner middle surface of the cylinder, which is placed over the push tube 17 until the support member 21 abuts against the shoulder 27 with the push cap 19 protruding through the opening 26. A retaining ring 28 is axially inserted into the cylinder 25 to hold the support member 21 in place.

Figure 6:
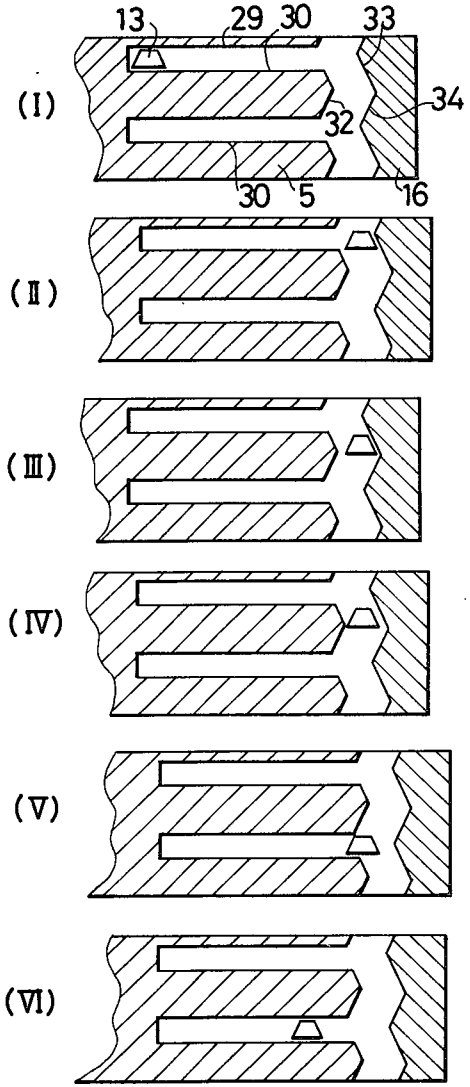
Figure 5:
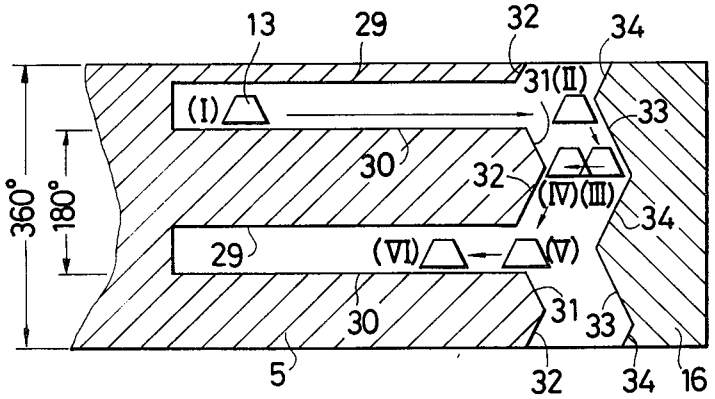

Referring now to FIG. 5, the configurations of the cam wall 5, the cam followers 13 and the annular cam ring 16 will be described. FIG. 5 is a plan view obtained by opening or flattening part of the cam wall and the cam ring, and in which the obliquely lined portions of the cam wall are flush with the inner wall of the slide cylinder and the white portions of the cam wall are cut or molded grooves which accomodate the protruding cam followers 13 of the support tube 11. Although two cam followers are actually disposed at symmetrical positions on diametrically opposite sides of the support tube, only one is shown in FIGS. 5 and 6 for convenience of description. The annular cam ring 16 is also shown by oblique lines, and is substantially flush with the obliquely lined portions of the cam wall 5.

The cam follower 13, as shown in FIG. 5, has a trapezoidal shape. The cam wall 5 defines a number of longitudinal grooves each formed by a first axially extending edge 29 and a second axially extending edge 30. A first oblique edge 31 and a second oblique edge 32 are defined at the rear end of each groove. The cam ring 16 is disposed opposite and slightly rotationally offset from the rear end of the cam wall 5, and comprises first oblique edges 33 and second oblique edges 34.

FIGS. 5 and 6 show the movement of the cam follower 13 between the cam wall 5 and the cam ring 16. For convenience of description, FIG. 5 shows the cam follower moving both horizontally (axially) and vertically relative to the cam wall and ring. In actual practice, however, the cam follower moves only vertically, and the cam wall and cam ring move horizontally, as clearly shown in FIG. 6. Thus, FIG. 6 shows the horizontal or axial movement of the cam wall and cam ring relative to the cam follower.

In FIG. 1 the writing section 9 is shown extending through the hole 3 of the slide cylinder 1, whereby the pen is in the writing state. The cam followers 13 are deep in the grooves of the cam wall 5, and the slide cylinder is partially withdrawn or retracted within the body cylinder 25. This condition is indicated by (I) in FIGS. 5 and 6.

To retract the writing section, the push cap 19 of the tube 17 is depressed. Since the support member 21 is inserted into the notch section 20 of the tube 17, the latter, as well as the slide cylinder 1 threaded thereto, cannot rotate. The slide cylinder is thus advanced, whereby the cam wall 5 and the cam ring 16 are moved to the left and the cam follower 13 eventually strikes against the first oblique edge 33 of the cam ring, as indicated by (II) in FIGS. 5 and 6.

The refill support tube 11 is designed to rotate in the hole 22 of the support member 21, whereby the further depression of the push tube 17 causes the cam follower 13 to rotate until it reaches the second oblique edge 34. During such rotation the slide cylinder is further advanced slightly, as shown at (III) in FIGS. 5 and 6, whereat the writing section 9 is completely retracted inside the slide cylinder.

When the push tube 17 is released the slide cylinder 1 starts to move back to the right under the force of the spring 24, until the cam follower strikes the second oblique edge 32 of the cam wall 5, as shown at (IV) in FIGS. 5 and 6.

The cam follower then slides along the edge 32, which continues the rotation of the cartridge 8, until it strikes the second axial edge 30 of the cam wall 5 as shown at (V) in FIGS. 5 and 6. As compared with state (I), the cam follower 13 has rotated exactly 180° in state (V), whereby the writing section 9 is now aligned with the receiving section 4.

Figure 4:
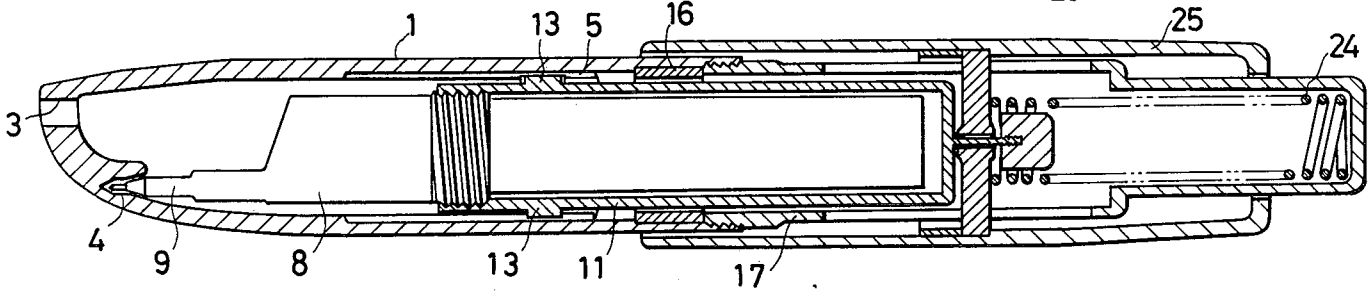
FIG. 4 shows a longitudinal sectional view of the pen according to the invention, with the writing section retracted, and FIGS. 5 and 6(I)–6(VI) are explanatory diagrams showing the operative interrelationships between the various cam members according to the invention.

As the slide cylinder 1 is not obstructed by anything in state (V) it continues to move to the right, until the writing section 9 enters and becomes seated in the receiving section 4 of the slide cylinder, as shown in FIG. 4, whereat the rearward movement of the slide cylinder is terminated, as indicated at (VI) in FIGS. 5 and 6. In this state, the seating of the writing section is maintained by the spring 24.

By again depressing and then releasing the push tube 17 the cartridge 8 is rotated another 180° and the writing section 9 is returned to state (I) , whereat it extends through the hole 3 of the slide cylinder.

It is to be understood that the cam wall 5, follower(s) 13, and ring 16 are not limited to the configurations shown in the figures. That is, it is only necessary that these elements convert the forward and backward movement of the slide cylinder and push tube into the rotary movement of the refill cartridge. Therefore, these elements may be replaced by others which achieve the necessary conversion. The shape and number of cam followers 13, cam wall grooves and oblique edges, and cam ring oblique edges can thus be modified in various ways. It is also obviously possible to provide the cam followers on the inside of the slide cylinder and to provide the cam wall and cam ring on the outside of the refill support tube 11.

It is preferable to cut the male thread 10 of the refill cartridge 8 and the female thread 12 of the support tube 11 in a direction opposite to the direction of rotation of these components, whereby their threaded engagement is more positively maintained. However, such engagement is not limited to screw threading, and any other suitable method may be employed. In addition, the means for securing the support tube 11 to the support member 21 is not limited to that shown in the figures, and any other suitable rotational coupling can be employed. For example, the support tube 11 may be rotatably mounted directly on the body cylinder 25.

Further, the refill support tube 11 may even be omitted, whereby the cam followers 13 can be provided on the outside of the refill cartridge and the latter can then be rotatably fastened directly to the support member 21 or the body cylinder 25.

While the cam wall 5 has been shown as cut into the inner wall of the slide cylinder 1, it may be replaced by a separate insert sleeve. The cam ring 16 may also be formed integral with the slide cylinder or push tube. The pen may also be designed to write by holding either the body cylinder 25 or the slide cylinder. In the latter case the writing pressure is supported by the force of the spring 24.

What is claimed is:

1. A retractable pen, comprising:

(a) a body cylinder, (b) a slide member slidably but non-rotatably disposed within the body cylinder and extending outwardly from both ends thereof, the front end of the slide member defining an axially offset open hole and an axially offset internal blind hole, (c) spring means biasing the slide member toward a retracted position within the body cylinder, (d) ink cartridge means having an axially offset writing tip disposed within the slide member, (e) means rotatably but non-slidably coupling the cartridge means to the body cylinder, (f) a cam wall and a cam ring disposed on the inside of the slide member or the outside of the cartridge means, the cam wall defining a pair of axially elongated, angularly spaced grooves joined at their one ends by configured edges, and the cam ring defining a configured edge generally matched to that of the cam wall but spaced therefrom, and (g) cam follower means disposed on the outside of the cartridge means or the inside of the slide member, respectively, and operatively engaged in the path defined by and between the cam wall and the cam ring, whereby the depression and release of the slide member sequentially effects the extension thereof, the rotation of the cartridge means and tip, and the retraction of the slide member, to thereby transfer the tip between a writing position whereat it extends through the open hole in the slide member and a retracted position whereat it is protectively seated in the internal blind hole.

2. A retractable pen as defined in claim 1, wherein the configured edges of the cam wall are zig-zag oblique edges, the configured edge of the cam ring is a zig-zag oblique edge angularly offset from the cam wall edges, and the cam follower means comprises at least one raised projection having a trapezoidal shape.

3. A retractable pen as defined in claim 2, wherein the cam wall grooves and the open and blind holes are angularly spaced 180° apart, respectively.

4. A retractable pen as defined in claim 3, wherein the coupling means comprises a member secured to and extending transversely across the body cylinder through the longitudinal axis thereof and through elongated notch means in the slide member, an axial pin on the rear end of the cartridge means extending through an axial hole in the transverse member, and a retaining member secured to the end of the pin.

5. A retractable pen as defined in claim 4, wherein the ink cartridge means comprises a replaceable cartridge member having the writing tip disposed thereon, and a support tube surrounding a portion of the cartridge member and axially coupled thereto, the pin being provided on the support tube.

* * * * *